United States Patent [19]

Sato et al.

[11] Patent Number: 4,592,935

[45] Date of Patent: Jun. 3, 1986

[54] HEAT-RESISTANT GALVANIZED IRON ALLOY WIRE

[75] Inventors: Kenichi Sato; Satoshi Takano; Kenji Miyazaki, all of Osaka, Japan

[73] Assignee: Sumitomo Electric Industries, Ltd., Osaka, Japan

[21] Appl. No.: 669,187

[22] Filed: Nov. 7, 1984

Related U.S. Application Data

[63] Continuation-in-part of Ser. No. 564,876, Dec. 23, 1983, Pat. No. 4,556,609.

[30] Foreign Application Priority Data

Dec. 24, 1982 [JP] Japan ..... 57-234317

[51] Int. Cl.[4] ..... C23C 1/02

[52] U.S. Cl. ..... 428/659; 427/433; 428/607

[58] Field of Search ..... 428/659, 607, 658; 427/433

[56] References Cited

U.S. PATENT DOCUMENTS 4,056,366 11/1977 Lee et al. ..... 428/659

4,057,424 11/1977 Bruno et al. ..... 428/659

OTHER PUBLICATIONS

Sasaki et al., "ZTACIR–New Extra–Heat Resistant Galvanized Invar–Reinforced Aluminum Alloy Conductor", *Sumitomo Electric Technical Review,* No. 24, 1–85, pp. 117–123.

*Primary Examiner*—L. Dewayne Rutledge
*Assistant Examiner*—Deborah Yee
*Attorney, Agent, or Firm*—Sughrue, Mion, Zinn, Macpeak & Seas

[57] ABSTRACT

A heat-resistant galvanized iron alloy wire is disclosed. The wire is comprised of an iron alloy wire core which may be an Fe-Ni type alloy. The core is coated on its periphery with a Zn-Al alloy. The alloy is comprised of 0.2 to 1.0 wt % Al with the balance being Zn, provided that Pb is present in an amount of less than 0.05 wt % and Sb is present in an amount of less than 0.02 wt %. The Zn-Al alloy may contain small amounts of typical impurities or compounds included in order to prevent the oxidation of the Zn or Al. The resulting wire has excellent heat-resistant properties.

9 Claims, No Drawings

HEAT-RESISTANT GALVANIZED IRON ALLOY WIRE

This application is a continuation-in-part, of application Ser. No. 564,876, filed Dec. 23, 1983 now U.S. Pat. No. 4,556,609.

FIELD OF THE INVENTION

This invention relates to a galvanized iron alloy wire, and more particularly to a heat-resistant galvanized iron alloy wire which excels in resistance to heat.

BACKGROUND OF THE INVENTION

In recent years, heat-resistant steel-core aluminum strands (hereinafter referred to as ACSR) have been used for the purpose of increasing power transmission capacity and improving reliability of power systems by one-line operation when there is trouble during the two-line operation. The iron alloy wires incorporated in such heat-resistant ACSR's for field use are generally obtained by coating steel wires of ACSR grade with aluminum or zinc.

Although the Al coating is excellent in resistance to corrosion and heat, it is expensive. The zinc coating improves the resistance of ACSR to corrosion, but to a lesser extent than the Al coating and is inexpensive. It nevertheless forms an Fe-Zn compound and loses toughness on exposure to heat. Further, zinc plating tends to be stripped at high temperatures as described in *Nippon Kinzoku Gakkai Shi,* 39 (1975), pp. 903–908. Since the temperature at which the ACSR's are used may rise as high as 245° C. at times, the zinc coating has failed to find extensive utility in application to cores of heat-resistant ACSR's.

There also exist zinc alloy coatings. For example, U.S. Pat. No. 4,029,478 describes a Zn-Al alloy coating containing about 0.06–0.15 wt% Pb as an essential component. U.S. Pat. No. 4,056,366 also uses a Zn alloy coating containing about 0.02 wt% Pb and 0.02–0.15 wt% Sb. U.S. Pat. No. 4,152,472 uses a zinc base alloy galvanizing bath containing 0.007–0.10 wt% Pb and 0.005–0.02 wt% Sn as well as Al. The sum of Pb and Sn amounts 0.012 wt% or more.

However, it has now been found that by limiting the amount of Al, Pb and Sb in a Zn-Al alloy coating, unexpectedly superior properties respecting heat resistance can be obtained.

SUMMARY OF THE INVENTION

This invention, perfected with a view to eliminating the drawbacks suffered by conventional ACSR's as described above, is aimed at providing a galvanized iron alloy wire having a zinc coating of notably improved thermal resistance such that the iron alloy wire may acquire thermal resistance optimum for the wire to be used in heat-resistant ACSR's in particular.

To be specific, this invention relates to a heat-resistant galvanized iron alloy wire comprising an iron alloy wire and a coating formed on the periphery of the iron alloy wire, the coating being a Zn-Al alloy substantially comprising 0.2 to 1.0 wt% of Al and the balance of Zn and including inevitably entrained impurities, provided that Pb is present in an amount of less than 0.05 wt% and Sb is present in an amount of less than 0.02 wt%.

DETAILED DESCRIPTION OF PREFERRED EMBODIMENTS

The iron alloy wire to be used in this invention usually has a diameter of about 2.0 to about 5.0 mm, preferably 2.6 to 4.8 mm and is formed of steel, special steel incorporating some alloy element, or an iron alloy. The Fe-Ni type alloy which is attracting keen attention on account of its small thermal expansion coefficient may be adopted as an iron alloy for this invention. This particular alloy may incorporate 35 to 42 wt% of Ni or incorporate a total of 0.2 to 10 wt% of at least one element selected from the group consisting of Cr, Mo, Si, Mn, C, Nb, Co, Al, Mg, and Ti. The incorporation of such additive elements is expected to bring about an effect of either strengthening the Fe-ni type alloy or preventing the thermal expansion coefficient from being increased.

Examples of the iron alloy wires which can be used in the present invention include a steel wire consisting of 0.62 wt% of C, 0.27 wt% of Si, 0.73 wt% of Mn and the balance being Fe and unavoidable impurities, a steel wire consisting of 0.80 wt% of C, 0.22 wt% of Si, 0.70 wt% of Mn and the balance being Fe and unavoidable impurities, and an Fe-Ni alloy wire consisting of 35 to 40 wt% of Ni, 2 to 5 wt% of Co, 0.2 to 0.8 wt% of C, 0.2 to 0.8 wt% of Si, 0.2 to 0.8 wt% of Mn and the balance being Fe and unavoidable impurities.

Formation of the Zn-Al type alloy coating on the iron alloy wire contemplated by this invention can be accomplished by any of various coating methods such as, for example, hot dipping, fusion, cladding or extrusion as described in, for example, U.S. Pat. Nos. 4,029,478, 4,056,366, 4,152,472 and 4,242,368, as far as a Zn-Al plating layer as thin as is contemplated by this invention such as about 50 to about 100 μm can be obtained. In this invention, hot dipping is generally used; other coating methods are unsatisfactory since it is difficult to make the plating layer sufficiently thin.

The present invention will now be described below with reference to a galvanized iron alloy wire for use in ACSR's. This invention is not limited to the galvanized iron alloy wire for this particular application. It embraces galvanized iron alloy wires intended for incorporation into structural materials which by nature are used under conditions not incapable of inducing elevation of temperature.

Generally, an iron alloy and Zn react to produce three compound layers, γ(gamma), δ(delta), and ζ(zeta), when fused Zn is deposited on the iron alloy or when the iron alloy already coated with Zn is heated. These Fe-Zn compounds impair the toughness of the galvanized iron alloy. When the galvanized iron alloy is heated at 300° C. for 100 hours, for example, the vibratory fatigue strength thereof is degraded. Heating at 300° C. for 100 hours also lowers the number of twists notably and under extreme conditions, results in separation of alloy layers along the interfaces in some, if not all, cases.

For the purpose of curbing the growth of such compound layers, the present invention adds 0.2 to 1.0 wt% of Al to Zn.

The addition of at least 0.2 wt% of Al to Zn curbs the otherwise possible growth of the compound layers formed between the Fe alloy and the Zn alloy while fused Zn is deposited on the iron alloy or when the iron alloy coated with Zn is heated. This addition is not effective when the amount of Al thus added is less than 0.2 wt%.

Further, the effect of curbing the growth of such compound layers is saturated and the viscosity of the fused Zn-Al alloy is increased and the separation of the coated iron alloy is seriously spoiled when the amount of Al so added exceeds 14 wt%.

If the amount of Al exceeds 1.0 wt%, the Al component in the fused Zn-Al alloy undergoes oxidation to produce dross and induces rigorous formation of $Al_3Fe$ due to the reaction with the iron alloy wire, making it necessary to pay due attention to controlling the amount of the Al component.

Further, the present invention facilitates the control of the components of the Zn-Al alloy by adding thereto Be, Ca, and rare earth elements such as La and/or Ce, which are capable of preventing Zn and Al from oxidation. The amount of each of these elements to be added thereto is properly selected in the range of 0.001 to 0.1 wt%, e.g., 0.005 wt%.

Zn generally employed in plating is electrolytic zinc having a purity of 99.99%. In the present invention, this electrolytic zinc is used to form a Zn-Al alloy. Substrates to be plated are Fe based or Fe-Ni based alloy wires and elements contained therein are dissolved in the bath for plating, thus being entrained in the plating layer as unavoidable impurities. The other elements discussed above need not be added to the coating composition intentionally and are considered to be present in a total amount of less than 0.01%.

The present invention aims at improvement on heat resistance and for this purpose it has been confirmed experimentally that impurities should be as little as possible. As will be clear from the Example, Pb and Sb, which are elements deteriorating heat resistance, are present in an amount of less than 0.05% and less than 0.02%, respectively. If Pb and Sb are contained in amounts of more than 0.05 wt% and more than 0.02 wt%, respectively, heat resistance is deteriorated; Pb and Sb precipitate in the Zn-Al alloy and the plating layer formed hardens and becomes brittle. Although this hardening proceeds at room temperature to some extent it proceeds very rapidly at high temperatures, e.g., about 300° C. For example, the plating layer will crack and come off from the substratum during the test for twisting when heated at 300° C. for 100 hours because of severe brittleness.

Formation of Zn-Al type alloy coating on the iron alloy wire contemplated by this invention can be accomplished generally by hot dipping an Fe-Ni alloy wire in a Zn-Al bath at a temperature of the liquids plus 10° to 30° C. although the optimum temperature depends on the content of Al. For example, when the content of Al is 0.5% a suitable temperature is from about 430° to 450° C. The length of time in which hot dipping is continued does not have any particular influence on the characteristics of the coated wire, and generally 3 to 60 seconds is sufficient. Before dipping, the Fe-Ni alloy wire is subjected to a pretreatment in order to obtain high quality coating. That is an Fe-Ni alloy wire is electrolytically degreased using a NaOH solution at a concentration of about 60 to 200 g/l at a temperature of 60° to 80° C. and at a current density of 5 to 20 A/dm$^2$ for 1 to 30 seconds, electrolytically pickled with a 30% $H_2SO_4$ solution at 10° to 35° C. and at a current density of 1,000 to 1,500 A/dm$^2$ for 1 to 10 seconds, heated in a weakly oxidizing heating furnace such as an air furnace at a temperature of 700° to 850° C. for 5 to 40 seconds and oxides present on the surface of the wire are removed in a reductive furnace, e.g., that containing 25% hydrogen gas at a temperature of 800° to 850° C. for 15 to 30 seconds.

EXAMPLE

An Fe-Ni alloy wire composed of 34 wt% Ni, 7 wt% in total of additive elements, i.e., Cr, Mo, Si, Mn, C, Nb, Co, Al, Mg and Ti, and the balance Fe and having a diameter of 3.0 mm was hot dipped in a Zn-Al bath containing 0.4 wt% Al and content of impurities as shown in the Table at 440° C. for 10 seconds after a pretreatment consisting of electrolytic degreasing using a NaOH solution (100 g/l) at 70° C. for 3 seconds at a current density of 10 A/dm$^3$, electrolytic pickling with a 30% $H_2SO_4$ solution at 25° C. and at a current density of 1,400 A/dm$^2$ for 1.5 seconds, heating in a weakly oxidizing heating furnace (air furnace) at 750° C. for 30 seconds, and removing oxides present on the surface of the wire in a reductive furnace containing 25% hydrogen gas at 830° C. for 20 seconds.

After the dipping, the coated wires were tested for appearance, number of twists in situ, number of twists after heating at 300° C. for 100 hours, and possible separation of the Zn layer during the test for twisting.

The results obtained are shown in the Table below.

From the Table, it can be seen that the samples of Test Nos. 1-4 according to the present invention retained the number of twists intact after heating at 300° C. for 100 hours and showed no sign of separation of the Zn layer during heating at 300° C. for 100 hours. Analysis of the interface between the coating and the Fe-Ni alloy using an X-ray microanalyser showed no development of Fe-Zn alloy (intermetallic) layers.

In contrast, samples of Comparative Test Nos. 5 and 7 showed separation of the plating layer and samples of Comparative Test Nos. 6 and 8 showed minute cracks and could not be used practically.

Upon X-ray microanalysis, samples of Comparative Test Nos. 5 and 7 showed development of an Fe-Zn intermetallic layer over the entire interface and samples of Comparative Test Nos. 6 and 8 also showed development of Fe-Zn alloy layer on a part of the interface.

TABLE

| Test | No. | Content of Impurities In Zn Al Bath Pb (wt %) | Sb (wt %) | Appearance | Number of Twists (twists/100D) | Number of Twists (twists/100D) | After Heating at 300° C. for 100 hrs. Separation of Zn |
|---|---|---|---|---|---|---|---|
| Invention | 1 | 0.001 | 0.001 | Good | 98 | 99 | No |
| Invention | 2 | 0.008 | 0.01 | Good | 99 | 98 | No |
| Invention | 3 | 0.015 | 0.001 | Good | 96 | 99 | No |
| Invention | 4 | 0.03 | 0.01 | Good | 97 | 100 | No |
| Comparative Experiment | 5 | 0.06 | 0.01 | Good | 99 | 8 | Yes |
| Comparative | 6 | 0.03 | 0.02 | Good | 101 | 38 | No |

TABLE-continued

| Test | No. | Content of Impurities In Zn Al Bath Pb (wt %) | Sb (wt %) | Appearance | Number of Twists (twists/100D) | Number of Twists (twists/100D) | After Heating at 300° C. for 100 hrs. Separation of Zn |
|---|---|---|---|---|---|---|---|
| Experiment | | | | | | | (Minute Cracks) |
| Comparative Experiment | 7 | 0.06 | 0.001 | Good | 96 | 17 | Yes |
| Comparative Experiment | 8 | 0.001 | 0.02 | Good | 95 | 78 | No (Minute Cracks) |

Effect of the Invention

The heat-resistant galvanized iron alloy wire of the present invention constructed as described above brings about the following effects.

The invention produces a heat-resistant galvanized iron alloy wire by depositing on the periphery of an iron alloy wire a coating of Zn-Al alloy substantially comprising 0.2 to 1.0 wt% of Al and the balance of Zn and including inevitably entrained impurities, provided that Pb is present in an amount of less than 0.05 wt% and Sb is present in an amount of less than 0.02 wt%. Inclusion of Al in the coating and limitation of the Pb and Sb curbs the growth of the Fe-Zn compound layer even when the coated iron alloy wire is exposed to heat during immersion in a fused alloy bath or heat used in thermal treatment performed after the Zn coating. Thus, the coated wire does not suffer from loss of toughness, strength or induce separation of the Zn layer. Compared with conventional galvanized iron alloy wires, the galvanized iron alloy wire of the present invention exhibits notably improved thermal resistance capable of withstanding elevated temperatures (about 300° C.).

The galvanized iron alloy wire of this invention provides very desirable materials which can be used as galvanized iron alloy wires or galvanized steel wires. These wires can be used for use in structural members such as, for example, reinforcing members in heat-resistant ACSR's. These wires can be used under elevated temperature conditions.

While the invention has been described in detail and with reference to specific embodiments thereof, it will be apparent to one skilled in the art that various changes and modifications can be made therein without departing from the spirit and scope thereof.

We claim:

1. A heat-resistant galvanized iron alloy wire, comprising:

an iron alloy wire core; and a coating formed on the periphery of the iron alloy wire core, the coating comprising a Zn-Al alloy consisting essentially of 0.2 to 1.0 wt% of Al and the balance of Zn and including inevitably entrained impurities, provided that Pb is present in an amount of less than 0.05% and Sb is present in an amount of less than 0.02 wt%, wherein the core is comprised of 35 to 42 wt% Ni and a total of 0.2 to 10 wt% of an element selected from the group consisting of Cr, Mo, Si, Mn, C, Nb, Co, Al, Mg, and Ti, the remainder of the alloy being Fe.

2. A heat-resistant galvanized iron alloy wire as claimed in claim 1, wherein the Zn-Al alloy contains 0.2 to 0.5 wt% of Al.

3. A heat-resistant galvanized iron alloy wire as claimed in claim 2, wherein the Zn-Al alloy contains 0.2 to 0.4 wt% of Al.

4. A heat-resistant galvanized iron alloy wire, comprising:

a base core comprised of an iron alloy; and coating formed on the periphery of the base core, the coating consisting essentially of Zn-Al alloy, the alloy consisting essentially of 0.2 to 1.0 wt% Al with the balance consisting essentially of Zn, provided that Pb is present in an amount of less than 0.05 wt% and Sb is present in an amount of less than 0.02 wt%, wherein the core is comprised of 35 to 42 wt% Ni and a total of 0.2 to 10 wt% of an element selected from the group consisting of Cr, Mo, Si, Mn, C, Nb, Co, Al, Mg, and Ti, the remainder of the alloy being Fe.

5. A heat-resistant galvanized iron alloy wire as claimed in claim 4, wherein the Zn-Al alloy contains 0.2 to 0.5 wt% of Al.

6. A heat-resistant galvanized iron alloy wire as claimed in claim 5, wherein the Zn-Al alloy contains 0.2 to 0.4 wt% of Al.

7. A heat-resistant galvanized iron alloy wire, comprising:

a base core comprised of an iron alloy wire; and a coating formed on the periphery of the core, the coating consisting essentially of a Zn-Al alloy consisting essentially of 0.2 to 1.0 wt% Al, 0.001 to 0.1 wt% of an element selected from the group consisting of Be, Ca, and rare earth elements capable of preventing oxidation of Zn and Al, the remainder of the alloy being Zn, provided that Pb is present in an amount of less than 0.05 wt% and Sb is present in an amount of less than 0.02 st%, wherein the core is comprised of 35 to 42 wt% Ni and a total of 0.2 to 10 wt% of an element selected from the group consisting of Cr, Mo, Si, Mn, C, Nb, Co, Al, Mg, and Ti, the remainder of the alloy being Fe.

8. A heat-resistant galvanized iron alloy wire as claimed in claim 7, wherein the Zn-Al alloy contains 0.2 to 0.5 wt% of Al.

9. A heat-resistant galvanized iron alloy wire as claimed in claim 8, wherein the Zn-Al alloy contains 0.2 to 0.4 wt% of Al.

* * * * *